US005270509A

United States Patent [19]

Gerling

[11] Patent Number: 5,270,509

[45] Date of Patent: Dec. 14, 1993

[54] MICROWAVE CLOTHES DRYING SYSTEM AND METHOD WITH IMPROVED ARC DETECTION

[75] Inventor: John E. Gerling, Twain Harte, Calif.

[73] Assignee: Electric Power Research Institute, Palo Alto, Calif.

[21] Appl. No.: 813,359

[22] Filed: Dec. 24, 1991

[51] Int. Cl.[5] ..... H05B 6/68

[52] U.S. Cl. ..... 219/10.55 B; 219/10.55 R; 219/10.55 M; 34/1 Q; 34/1 P

[58] Field of Search ..... 219/10.55 R, 10.55 M, 219/10.55 F, 10.55 B, 10.55 A; 34/1 Q, 1 P, 1 DD, 1 R; 361/1, 2

[56] References Cited

U.S. PATENT DOCUMENTS 3,439,431 4/1969 Heidtmann .
3,854,219 12/1974 Staats .
4,009,359 2/1977 Tallmadge et al. ..... 219/10.55 B
4,057,907 11/1977 Rapino et al. .
4,250,628 2/1981 Smith et al. .
4,334,136 6/1982 Mahan et al. .
4,356,640 11/1982 Jansson .
4,490,923 1/1985 Thomas .
4,510,361 4/1985 Mahan .
4,510,697 4/1985 Beasley et al. .
4,523,387 6/1985 Mahan .
4,663,508 5/1987 Ishimura et al. .
4,703,565 11/1987 Kantor .
4,765,066 8/1988 Yoon .
4,771,156 9/1988 Strattan et al. .
4,795,871 1/1989 O'Connor et al. .
4,829,679 1/1989 O'Connor et al. .
4,856,203 8/1989 Wennerstrum .
4,896,010 1/1990 O'Connor et al. .

FOREIGN PATENT DOCUMENTS 1-248490 10/1989 Japan ..... 219/10.55 B

*Primary Examiner*—Philip H. Leung
*Attorney, Agent, or Firm*—Flehr, Hohbach, Test et al.

[57] ABSTRACT

Microwave drying system and method in which arcing is detected by a sudden drop in electric field strength within the drying chamber. An electric signal corresponding to field strength is provided and, in one disclosed embodiment, is compared with a reference signal which varies with changes in field strength which occur more slowly than changes due to arcing. The two signals are compared, and an output signal is provided if the two signal differ by more than a predetermined amount. This permits the sudden drop which accompanies arcing to be distinguished from more gradual changes in the electric field which occur, for example, as moisture is evaporated from the clothing or other articles being dried.

12 Claims, 2 Drawing Sheets

MICROWAVE CLOTHES DRYING SYSTEM AND METHOD WITH IMPROVED ARC DETECTION

This invention pertains generally to the drying of articles such as clothes and, more particularly, to a microwave clothes dryer and method with improved arc detection.

Heretofore, dryers utilizing microwave energy for evaporating moisture have been provided for drying clothes and other articles. Examples of such dryers are found in U.S. Pat. Nos. 4,250,628, 4,765,066, 4,490,923, 4,663,508 and 3,439,431.

One problem of considerable concern in microwave dryers is arcing between metal objects such as buttons or zippers on the clothing and metal parts of the dryer itself. Such arcing can result in damage to the dryer and/or the clothes and can even lead to fires which may destroy surrounding structures.

One way to avoid the problem of arcing is to hold the electric field strength at a level which is low enough that arcing cannot occur. This, however, is generally not practical since such a low level will result in inefficient dryer operation.

A better approach is to detect arcing as it first occurs and to take preventative measures before any damage can occur. Arc detectors currently used in microwave dryers most commonly rely upon optical detection wherein a sensor such as a light sensitive resistor or a photomultiplier monitors the area in which an arc might occur and responds to light emitted by an arc.

Another technique, which is less widely used, utilizes a sound detector which responds to noise emitted by an arc.

Each of these techniques has certain limitations and disadvantages. With a photo detector, the arc might take place in an area where the clothes would shield the light and prevent the detector from detecting it. With a sound detector, the arc might occur in an area where the clothes would muffle the noise and prevent the sound detector from detecting it.

It is in general an object of the invention to provide an new and improved microwave clothes drying system and method with improved arc detection.

Another object of the invention is to provide a microwave clothes drying system and method of the above character which overcome the limitations and disadvantages of arc detectors heretofore employed in such systems.

These and other objects are achieved in accordance with the invention by providing a microwave drying system and method in which arcing is detected by a sudden drop in electric field strength within the drying chamber. An electric signal corresponding to field strength is provided and, in one disclosed embodiment, is compared with a reference signal which varies with changes in field strength which occur more slowly than changes due to arcing. The two signals are compared, and an output signal is provided if the two signal differ by more than a predetermined amount. This permits the sudden drop which accompanies arcing to be distinguished from more gradual changes in the electric field which occur, for example, as moisture is evaporated from the clothing or other articles being dried.

Figure 1:
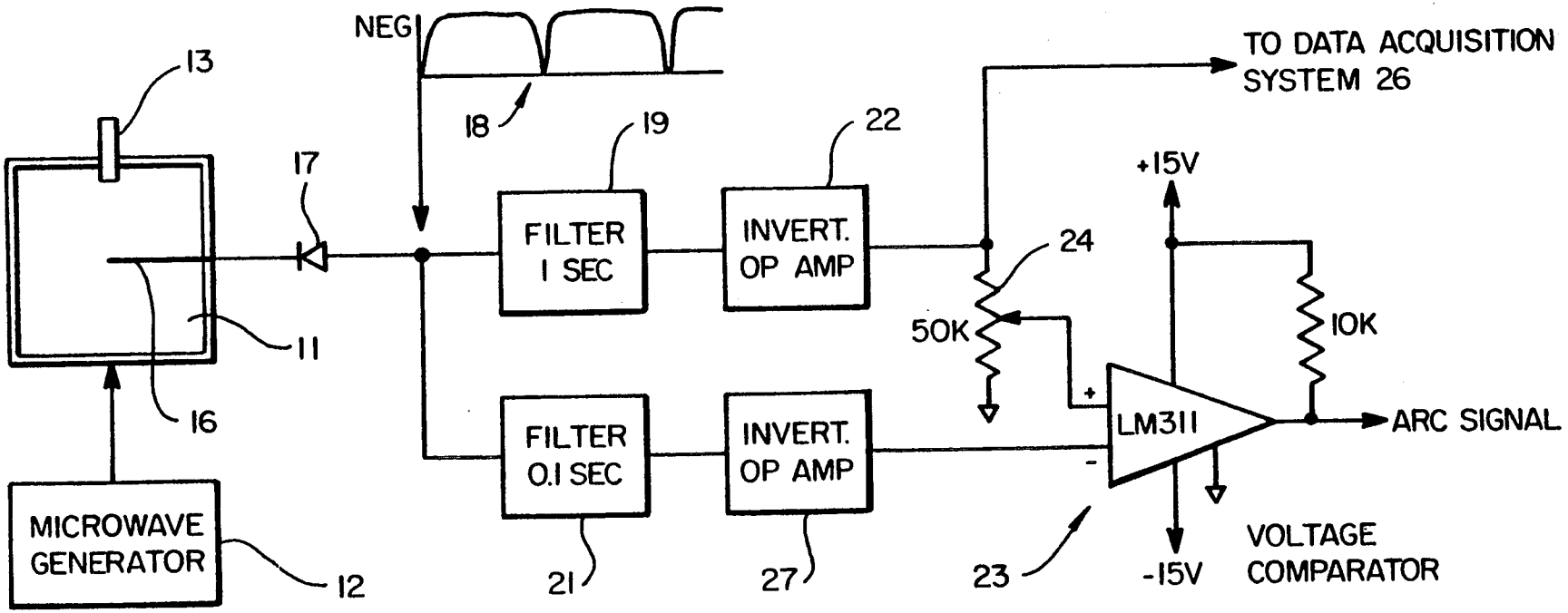
FIG. 1 is a block diagram of one embodiment of a clothes drying system according to the invention.

In FIG. 1, the invention is illustrated in connection with a clothes drying system having a microwave cavity or chamber 11 for receiving the clothes or fabrics to be dried. Microwave energy is introduced into the chamber from a source 12 of conventional design to evaporate moisture in the clothes. The vaporized moisture is exhausted from the chamber through a vent 13 of conventional design.

A probe 16 extends through a wall of the chamber for monitoring electric field strength within the chamber and providing a signal corresponding thereto. Alternately, field strength can be monitored by other means such as a coupling iris and a sensor for detecting microwave energy passing through the coupling iris.

Electric field strength is a function of the power delivered to the chamber and the microwave responsive load within the chamber, and is governed by the relationship $$P=e^2/r,$$

where P is the power delivered to the chamber, e is the electric field strength within the chamber, and r is the inverse of the effective load within the chamber.

As the effective load decreases, e.g. as water is evaporated from the clothes, the field strength increases, and the field strength signal can be utilized as an indicator as to how the drying process is progressing. An arc constitutes a very good load to microwave energy, and the field strength suddenly drops whenever arcing occurs. By monitoring the field strength signal, it is possible to detect arcing at an early stage and take corrective action such as interrupting or reducing the microwave power supplied to the chamber before damage occurs.

The signal from the probe varies cyclically as the electric field builds up and collapses with the microwave power. This signal is rectified by a diode 17 to provide a waveform 18 which rises and falls with each half cycle of the applied power.

The rectified signal is applied to a pair of smoothing filters 19, 21 which to provide D.C. waveforms (not shown) corresponding to the field strength. Filter 19 has a greater time constant than filter 21 and provides a reference signal corresponding to operation of the dryer under normal conditions, i.e. in the absence of arcing. Filter 21 has a faster time constant and provides a signal which varies almost instantaneously with changes due to arcing as well as slower changes in the electric field. In one presently preferred embodiment, filter 19 has a time constant of 1.0 second, and filter 21 has a time constant of 0.1 second.

The output of filter 19 is connected to the input of an inverting op amp 22, and the output of the op amp is connected to the positive input of a voltage comparator 23 through a potentiometer 24. The output of op amp 22 is also applied to a data acquisition system 26 for use in monitoring the operation of the clothes dryer. The output of filter 21 is connected to the input of an inverting op amp 27, and the output of this op amp is connected to the negative input of the voltage comparator. The comparator delivers an output signal when the signal from filter 21 differs from the reference signal from filter 19 by an amount set by potentiometer 24.

Figure 2:
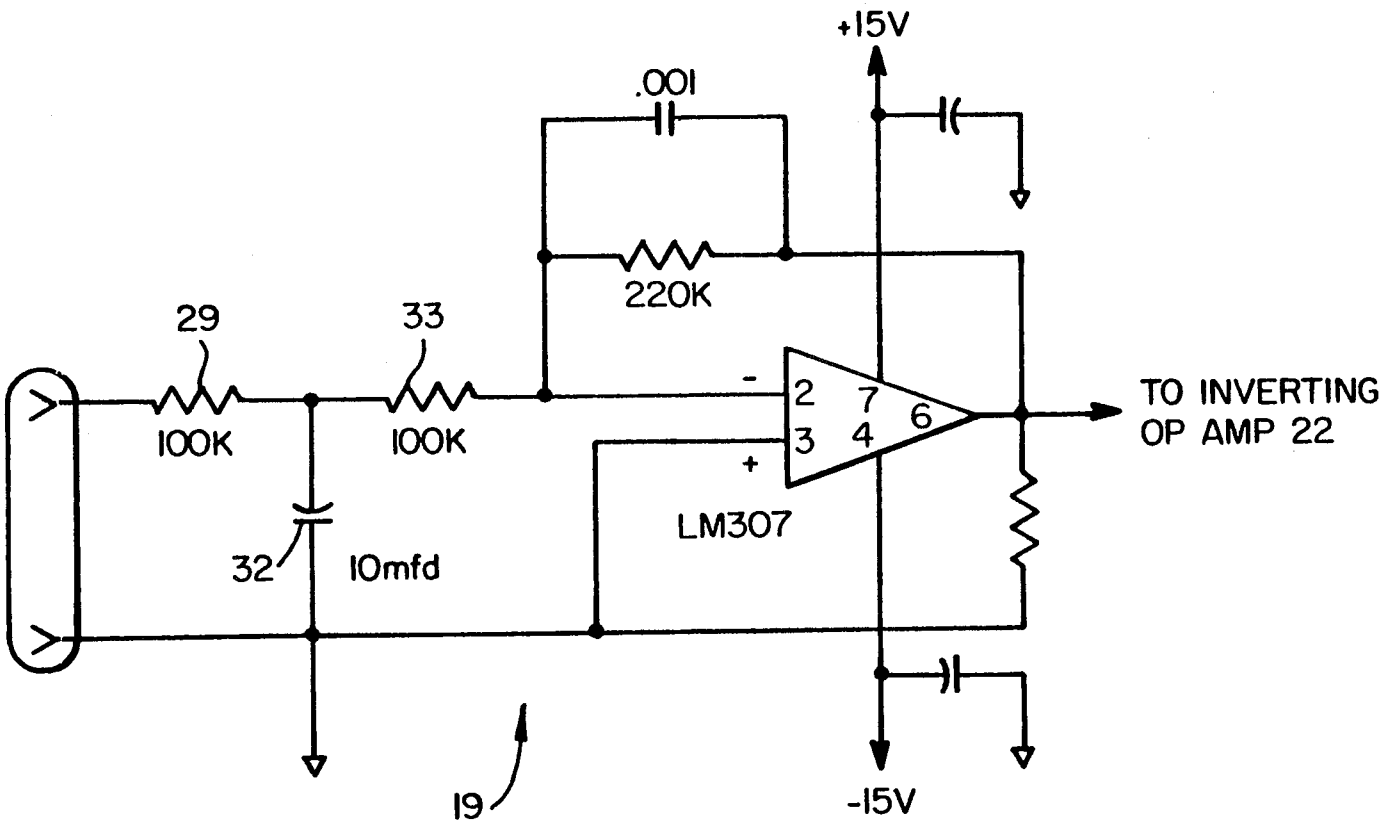
FIG. 2 is a circuit diagram of a filter in the embodiment of FIG. 1.

As illustrated in FIG. 2, filter 19 is a low pass filter comprising a 100K ohm resistor 29 and a 10 mfd capacitor 31. Filter 21 is identical to filter 19, except it has a 1 mfd capacitor instead of the 10 mfd capacitor. The output of filter 19 is applied to the inverting input of op amp 22 through a 100K ohm coupling resistor 33, and the output of filter 21 is applied to the inverting input of op amp 27 in a similar manner.

Operation and use of the dryer system, and therein the method of the invention, are as follows. Clothes to be dried are placed in the chamber, and microwave energy is introduced into the chamber to evaporate moisture in the clothes. As the moisture evaporates, the effective load in the chamber decreases, and the electric field strength monitored by probe 16 and the rest of the arc detector increases. This increase and other changes in field strength during normal operation of the dryer occur slowly enough that the signals from both filters follow them at substantially the same rate, and there is no output from the comparator.

In the event that arcing occurs, the strength of the electric field drops suddenly, and the signal from filter 21 drops with it, with the signal from filter 19 lagging behind. This sudden difference in the two signals is detected by the comparator which delivers an output signal to indicate the occurrence of an arc. This signal can be utilized as desired to stop the arcing before any damage can occur.

It is apparent from the foregoing that a new and improved microwave clothes drying system and method with arc detection have been provided. While only certain presently preferred embodiments have been described in detail, as will be apparent to those familiar with the art, certain changes and modifications can be made without departing from the scope of the invention as defined by the following claims.

I claim:

1. In a microwave clothes dryer: a drying chamber for receiving fabrics to be dried, means for introducing microwave energy into the chamber to evaporate moisture from the fabrics, and means for monitoring electric field strength within the chamber and providing an output signal in the event of a decrease in the field strength due to arcing.

2. The microwave clothes dryer of claim 1 wherein the means for monitoring field strength and providing an output signal comprises means for providing a signal corresponding to the field strength, means for providing a reference signal which varies with changes in field strength which occur more slowly than changes due to arcing, and means for comparing the field strength signal with the reference signal and delivering an output signal if the field strength signal differs from the reference signal by more than a predetermined amount.

3. The microwave clothes dryer of claim 1 wherein the means for monitoring field strength and providing an output signal comprises a detector for providing a signal corresponding to the strength of the electric field, a first circuit having a time constant T for providing a first signal in response to the electric field signal, a second circuit having a time constant on the order of 10T for providing a second signal in response to the electric field signal, and means for comparing the first and second signals and providing an output signal if the signals differ by more than a predetermined amount.

4. In a system for detecting arcing in a chamber in which microwave energy is present: means for monitoring electric field strength within the chamber and providing a signal corresponding thereto, means for providing a reference signal which varies with changes in field strength which occur more slowly than changes due to arcing, and means for monitoring the field strength signal and the reference signal to detect a change in the field strength due to arcing.

5. In a system for detecting arcing in a chamber in which microwave energy is present: means for monitoring electric field strength within the chamber and providing a signal corresponding thereto, means for providing a reference signal which varies with changes in field strength which occur more slowly than changes due to arcing, and means for comparing the field strength signal with the reference signal and delivering an output signal if the field strength signal differs from the reference signal by more than a predetermined amount.

6. In a system for detecting arcing in a chamber in which microwave energy is present: means for monitoring electric field strength within the chamber and providing a signal corresponding thereto, a detector for providing a signal corresponding to the strength of the electric field, a first circuit having a time constant T for providing a first signal in response to the electric field signal, a second circuit having a time constant on the order of 10T for providing a second signal in response to the electric field signal, and means for comparing the first and second signals and providing an output signal if the signals differ by more than a predetermined amount.

7. In a microwave clothes drying method, the steps of: placing fabrics to be dried in a drying chamber, introducing microwave energy into the chamber to evaporate moisture from the fabrics, monitoring electric field strength within the chamber, and providing an output signal in the event of a decrease in the field strength due to arcing.

8. The method of claim 7 wherein the field strength is monitored and the output signal is provided by providing a signal corresponding to the field strength, providing a reference signal which varies with changes in field strength which occur more slowly than changes due to arcing, and comparing the field strength signal with the reference signal, and delivering an output signal if the field strength signal differs from the reference signal by more than a predetermined amount.

9. The method of claim 7 wherein the field strength is monitored and the output signal is provided by providing a signal corresponding to the strength of the electric field, applying the field strength signal to a first circuit having a time constant T to provide a first signal in response to the electric field signal, applying the field strength signal to a second circuit having a time constant on the order of 10T to provide a second signal in response to the electric field signal, comparing the first and second signals, and providing an output signal if the first and second signals differ by more than a predetermined amount.

10. In a method of detecting arcing in a chamber in which microwave energy is present, the steps of: monitoring electric field strength within the chamber and providing a signal corresponding thereto, providing a reference signal which varies with changes in field strength which occur more slowly than changes due to arcing, and monitoring the field strength signal and the reference signal to detect a change in the field strength due to arcing.

11. In a method of detecting arcing in a chamber in which microwave energy is present, the steps of: monitoring electric field strength within the chamber and providing a signal corresponding thereto, providing a reference signal which varies with changes in field strength which occur more slowly than changes due to arcing, and comparing the field strength signal with the reference signal, and delivering an output signal if the field strength signal differs from the reference signal by more than a predetermined amount.

12. In a method of detecting arcing in a chamber in which microwave energy is present, the steps of: monitoring electric field strength within the chamber and providing a signal corresponding thereto, applying the field strength signal to a first circuit having a time constant T to provide a first signal in response to the electric field signal, applying the field strength signal to a second circuit having a time constant on the order of 10T to provide a second signal in response to the electric field signal, comparing the first and second signals, and providing an output signal if the first and second signals differ by more than a predetermined amount.

* * * * *